US007806511B2

(12) United States Patent
Ishikawa

(10) Patent No.: US 7,806,511 B2
(45) Date of Patent: Oct. 5, 2010

(54) LIQUID EJECTION APPARATUS

(75) Inventor: Hiroyuki Ishikawa, Nissin (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 384 days.

(21) Appl. No.: 12/079,438

(22) Filed: Mar. 27, 2008

(65) Prior Publication Data

US 2008/0239001 A1 Oct. 2, 2008

(30) Foreign Application Priority Data

Mar. 30, 2007 (JP) ..... 2007-093612
Jun. 8, 2007 (JP) ..... 2007-152599

(51) Int. Cl.
*B41J 2/045* (2006.01)

(52) U.S. Cl. ..... 347/40; 347/71

(58) Field of Classification Search ..... 347/40, 347/12, 43, 67, 68, 71
See application file for complete search history.

(56) References Cited

U.S. PATENT DOCUMENTS 7,452,060 B2 * 11/2008 Nakamura et al. ..... 347/71
7,494,210 B2 * 2/2009 Yamada et al. ..... 347/71
7,520,596 B2 * 4/2009 Yasui ..... 347/71

FOREIGN PATENT DOCUMENTS

JP 4235057 8/1992

* cited by examiner

*Primary Examiner*—Lamson D Nguyen
(74) *Attorney, Agent, or Firm*—Frommer Lawrence & Haug LLP

(57) ABSTRACT

In a liquid ejection apparatus, common liquid chambers adjacent to each other and connection passages extending from the adjacent common liquid chambers are separated by a partition wall. The partition wall has a first side surface and a second side surface opposite the first side surface. The first side surface define one of side surfaces of the common chamber and one of side surfaces of the connection passage extending from the common chamber. The second side surface defines one of side surfaces of the other common chamber and one of side surfaces of the other connection passage extending from the other common chamber. The partition wall has a curved surface connecting the first side surface to the second side surface in a vicinity of a position where the connection passages having the partition wall placed therebetween are connected to each other. A curvature of the curved surface is larger than a curvature of an arc having a diameter equal to a width of the partition wall.

10 Claims, 13 Drawing Sheets

LIQUID EJECTION APPARATUS

CROSS REFERENCE TO RELATED APPLICATION

The present disclosure relates to the subject matter contained in Japanese patent application Nos. 2007-093612 (filed on Mar. 30, 2007) and 2007-152599 (filed on Jun. 8, 2007), each of which is expressly incorporated herein by reference in its entirety.

TECHNICAL FIELD

The present invention relates to a liquid ejection apparatus for ejecting liquid from a plurality of nozzles.

BACKGROUND ART

An ink jet head is one of embodiments of a liquid ejection apparatus, and is configured to eject ink as liquid from nozzles onto a medium such as a recording sheet.

Japanese Published Examined Patent Application No. 3036548 discloses an ink jet head having an air bubble discharge mechanism that prevents an air bubble flowing in a reservoir part of a head from further flowing into a pressure chamber (see, for example, Paragraphs 0010 through 013 and FIG. 3). The mechanism is as follows: An air bubble (B1) flowing in a flow passage reaches the vicinity of a first air bubble discharge hole (11) to be naturally discharged from the first air bubble discharge hole (11) to the outside of a head or stagnated in a relatively wide region (1*a*) in the vicinity of the first air bubble discharge hole (11). An air bubble (B2) which reaches a second air bubble discharge hole (12) is naturally discharged therefrom to the outside of the head or stagnated in a relatively wide region (1*b*) in the vicinity of the second air bubble discharge hole (12). The air bubbles stagnated in the regions (1*a*, 1*b*) are discharged to the outside of the head by air bubble sucking operation. Fins (10) are provided at every inlet of a supply passage (2) to prevent an air bubble (B3) from flowing into the supply passage (2) and to move the air bubble (B3) toward the second air bubble discharge hole (12). FIG. 12 is a plan view showing a manifold plate 6 of a prototype ink jet head 1 that was prepared by the present inventor of this application to investigate flows of ink in a plurality of common liquid chambers 3. The ink jet head 1 has passages extending from liquid supply ports 2 via the common liquid chambers 3 and pressure chambers 5 to nozzles 4. To accommodate high resolution recording requirement in recent years, the ink jet head 1 is configured such that the nozzles 4 are arrayed into multiple rows and the common liquid chamber 3 is provided for each row of the nozzles 4. Further, to achieve stabilized ink ejection (a larger capacity of the common liquid chamber 3 is preferable), while making the entire ink jet head smaller in size, the ink jet head 1 is configured to have a common passage 7 by which adjacent common liquid chambers 3 are connected to each other at the opposite side of the ink supplying ports 2.

The common passage 7 is formed symmetrically around a virtual center surface 8 between two adjacent common liquid chambers 3 to present a substantially semi-circular arc-shape (a substantially U-shape in combination with the two adjacent common liquid chambers 3). A discharge port 9 is formed at the intermediate part in the common passage 7.

FIG. 13 shows chronologically changes of ink flows, which were obtained by simulating the ink flows when supplying ink in the common liquid chambers 3 and common passages 7 in the ink jet head 1 shown in FIG. 12. In this simulation, in a state where the pressure acting on the ink supplying ports 2 was fixed, negative pressure was given to the discharge port 9, and the pressure was gradually reduced from time 0 milliseconds. FIG. 13(*a*) shows a state of ink at time 0 milliseconds when supplying of ink to the ink supplying ports 2 was commenced, and FIGS. 13(*b*), (*c*), (*d*), (*e*), (*f*), (*g*), (*h*), (*i*), (*j*) and (*k*) respectively show a state of ink at 3.0 milliseconds, 4.0 milliseconds, 5.0 milliseconds, 6.0 milliseconds, 7.0 milliseconds, 7.5 milliseconds, 8.0 milliseconds, 8.5 milliseconds, 9.0 milliseconds, and 12.0 milliseconds after supplying of ink to the ink supplying ports 2 was commenced. With the ink jet head 1, if negative pressure is given to the discharge port 9 with two common ink chambers 3 in an empty state, ink is supplied from the liquid supplying ports 2 to the common ink chambers 3 as shown in FIG. 13. Therefore, the interior of the common ink chambers 3 and the common passage 7 is gradually filled with ink (Refer to FIG. 13(*a*) to (*j*)).

In case of the ink jet head 1, ink that has flown through two common ink chambers 3 further flows in the extension direction of the common ink chambers 3 even if it reaches the tip end wall side 3*a* of the partition wall between the common ink chambers 3 (Refer to FIGS. 13(*f*) and (*g*)). Therefore, spacing is formed at the extension portion of the tip end wall side 3*a* in ink that has flown through the two ink common chambers 3. Since the common passage 7 is formed to be left-right symmetrical around the virtual center surface, even if left-right symmetrical flows are made close to each other along the common passage 7 and join together, air in the spacing of the extension portion of the tip end wall side 3*a* is left as an air bubble 10 (Refer to FIG. 13(*i*)). Even if the discharge port 9 is provided in the vicinity of the tip end wall side 3*a*, an air bubble 10 is left over at the end part of the downstream side of the common passage 7 (Refer to FIG. 13(*j*)). Since the flows are left-right symmetrical, joined inks flow toward the discharge port 9 as is without producing any vortex flow. Accordingly, the air bubble 10 left over subsequently stagnates as it is (Refer to FIG. 13(*k*)). If the air bubble 10 stagnates, the air bubble 10 may be guided toward the nozzle 4 when ink is ejected from the nozzle 4, resulting in defective ejection at the nozzle 4, thereby producing faulty images.

SUMMARY

As one of illustrative, non-limiting embodiment, the present invention can provide a liquid ejection apparatus, including: plural nozzles for ejecting liquid therefrom; plural pressure chamber groups, each group including plural pressure chambers, the pressure chambers of the plural pressure chamber groups respectively communicating with the plural nozzles to eject the liquid from the plural nozzles by pressure fluctuations; a common liquid chamber group including plural common liquid chambers, each of the plural common liquid chambers being provided for and connected to the plural pressure chambers of a respective one of the pressure chamber groups, and being supplied with the liquid to be ejected from the nozzles communicating with the pressure chambers of the respective one of the pressure chamber groups; liquid supplying ports respectively connected to one ends of the common liquid chambers to supply the liquid to the common liquid chambers; a common passage including plural connection passages respectively extending from other ends of the common liquid chambers and connected to one another; and a discharge port formed in the common passage and opened to the exterior; wherein the common liquid chambers adjacent to each other and the connection passages extending from the adjacent common liquid chambers are separated by a partition wall, the partition wall having a first side surface and a second side surface opposite the first side surface, the first side surface defining one of side surfaces of the common chamber and one of side surfaces of the connection passage extending from the common chamber, the second side surface defining one of side surfaces of the other common chamber and one of side surfaces of the other connection passage extending from the other common chamber; and the partition wall has a curved surface connecting the first side surface to the second side surface in a vicinity of a position where the connection passages having the partition wall placed therebetween are connected to each other, and a curvature of the curved surface is larger than a curvature of an arc having a diameter equal to a width of the partition wall.

Accordingly, as one of advantages, the present invention can provide a liquid ejection apparatus which can prevent air bubbles from stagnating in a common passage connecting common liquid chambers. As another one of the advantages, the present invention can provide a liquid ejection apparatus which can eliminate defective ejection of nozzles resulting from air bubbles.

These and other advantages of the present invention will be described in detail with reference to the accompanying drawings.

DESCRIPTION OF THE PREFERRED EMBODIMENT

Illustrative, non-limiting embodiments of the present invention will be discussed with reference to the accompanying drawings.

EXAMPLE 1

Figure 1:
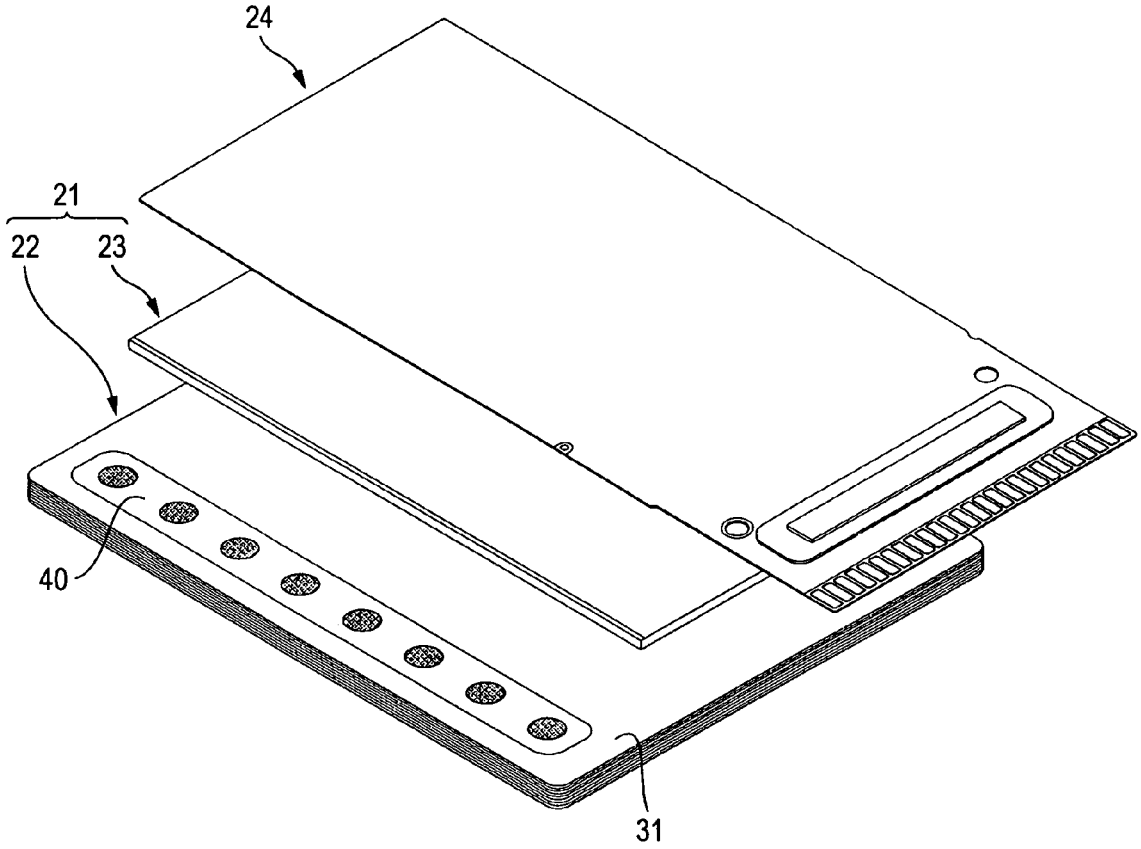
FIG. 1 is an exploded perspective view showing an ink jet head 21 according to Example 1.

FIG. 1 is an exploded perspective view showing an ink jet head 21 according to Example 1. As shown in FIG. 1, the ink jet head 21 includes a passage unit 22, in which a plurality of plates are laminated, and a piezoelectric actuator 23 laminated on and adhered to the passage unit 22. The passage unit 22 is of a face ejection type in which ink is ejected from a nozzle 47 (Refer to FIG. 3) in a lamination direction. A flexible flat cable 24 for electrical connections to peripheral devices is overlaid on the upper surface of the piezoelectric actuator 23, and terminals (not illustrated) exposed to the underside of the flexible flat cable 24 are connected to surface electrodes (not illustrated) formed on the upper surface of the piezoelectric actuator 23.

In the following description, directions are expressed such that, with respect to the passage unit 22, the side where the piezoelectric actuator 23 is provided is upward, and the side opposite thereto is downward. This is for the purpose of ease of explanation only, and should not be interpreted in a restrictive sense.

Figure 2:
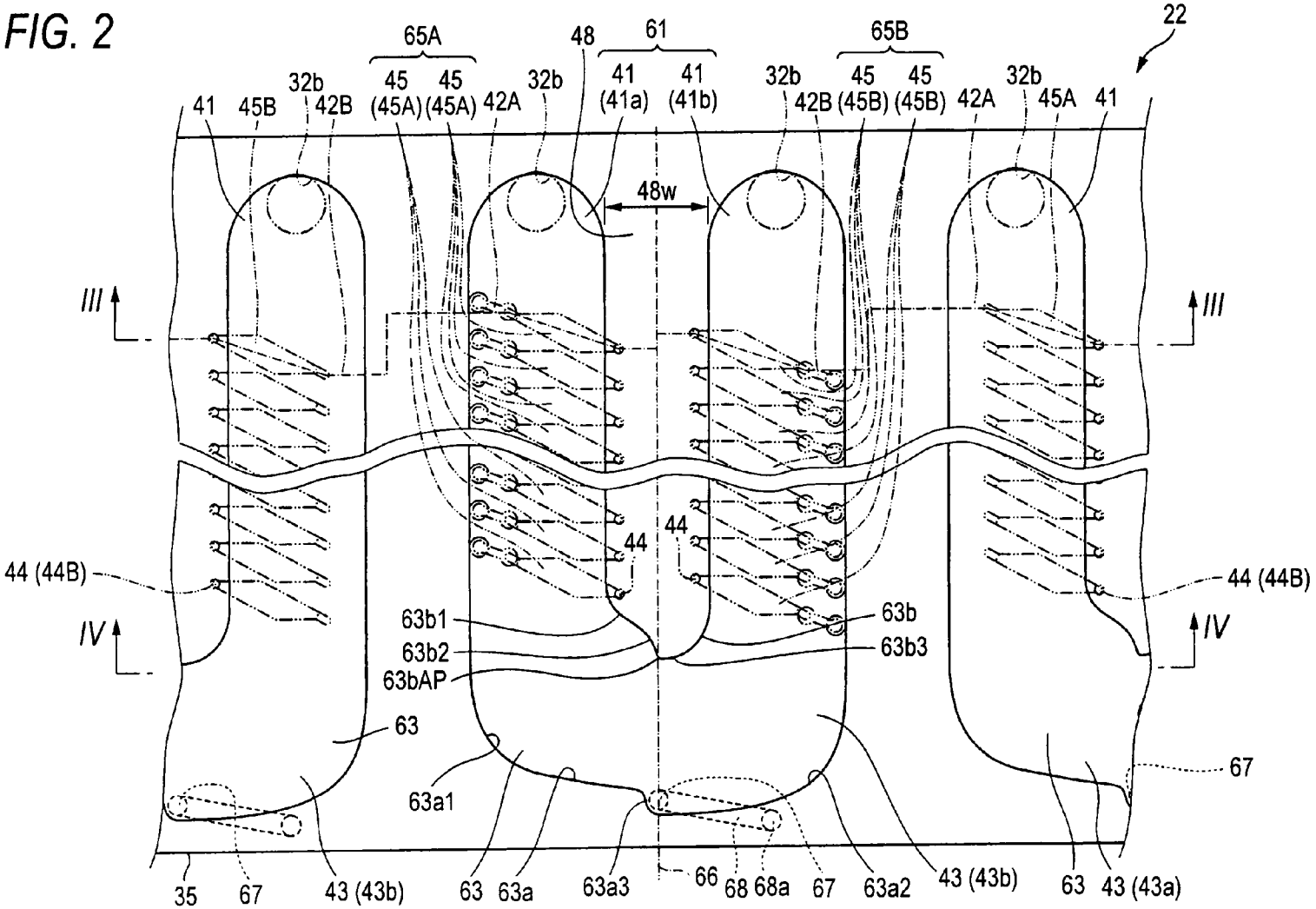
FIG. 2 is a plan view showing a manifold plate in a passage unit 22 shown in FIG. 1.
Figure 3:
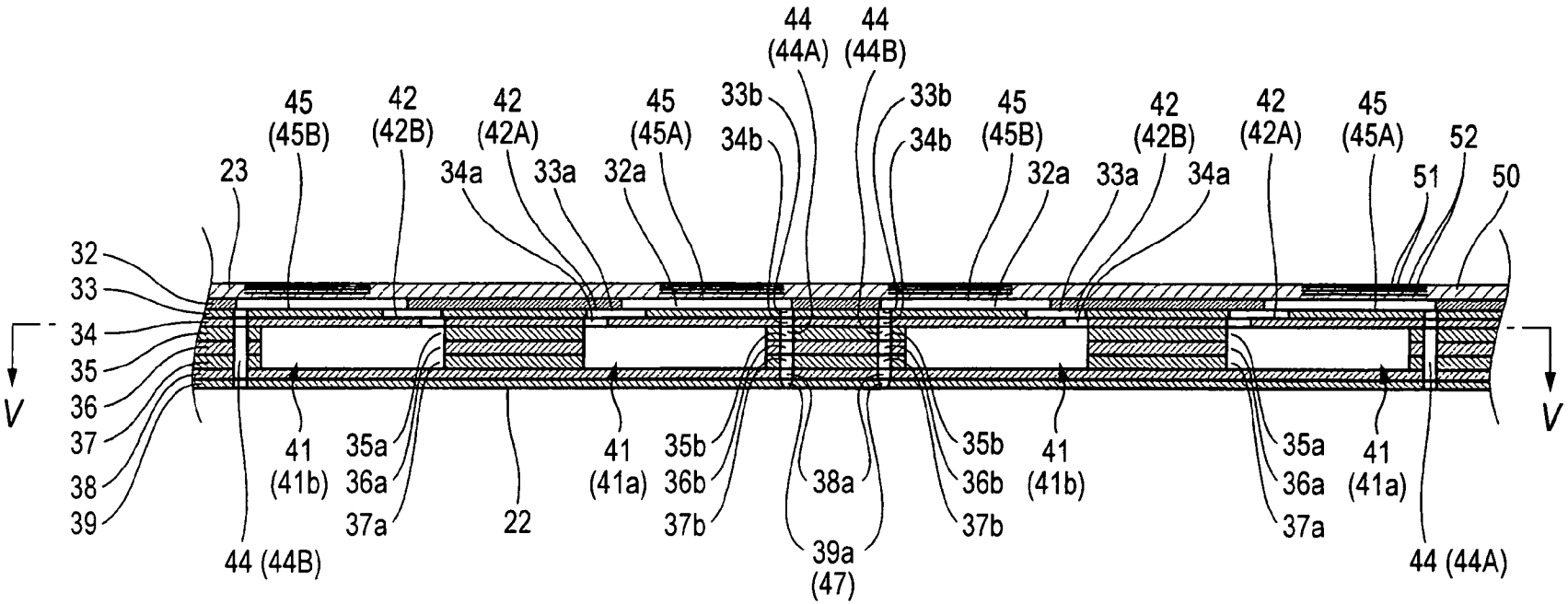
FIG. 3 is a sectional view of an ink jet head, which is taken along the line III-III in FIG. 2.
Figure 4:
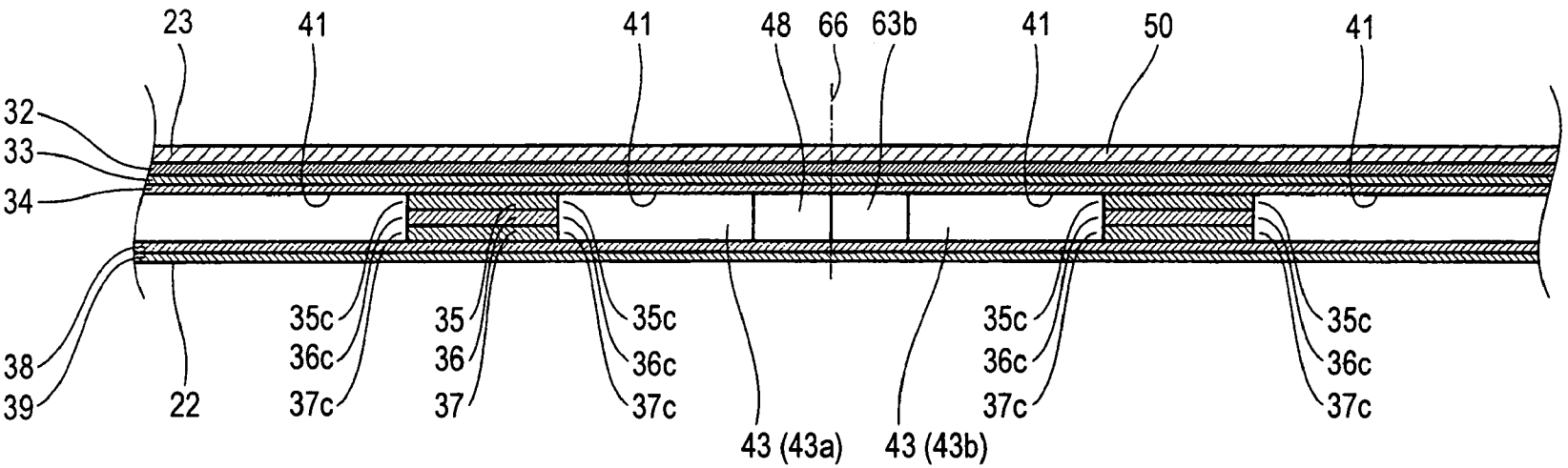
FIG. 4 is a sectional view of an ink jet head, which is taken along the line IV-IV in FIG. 2.
Figure 5:
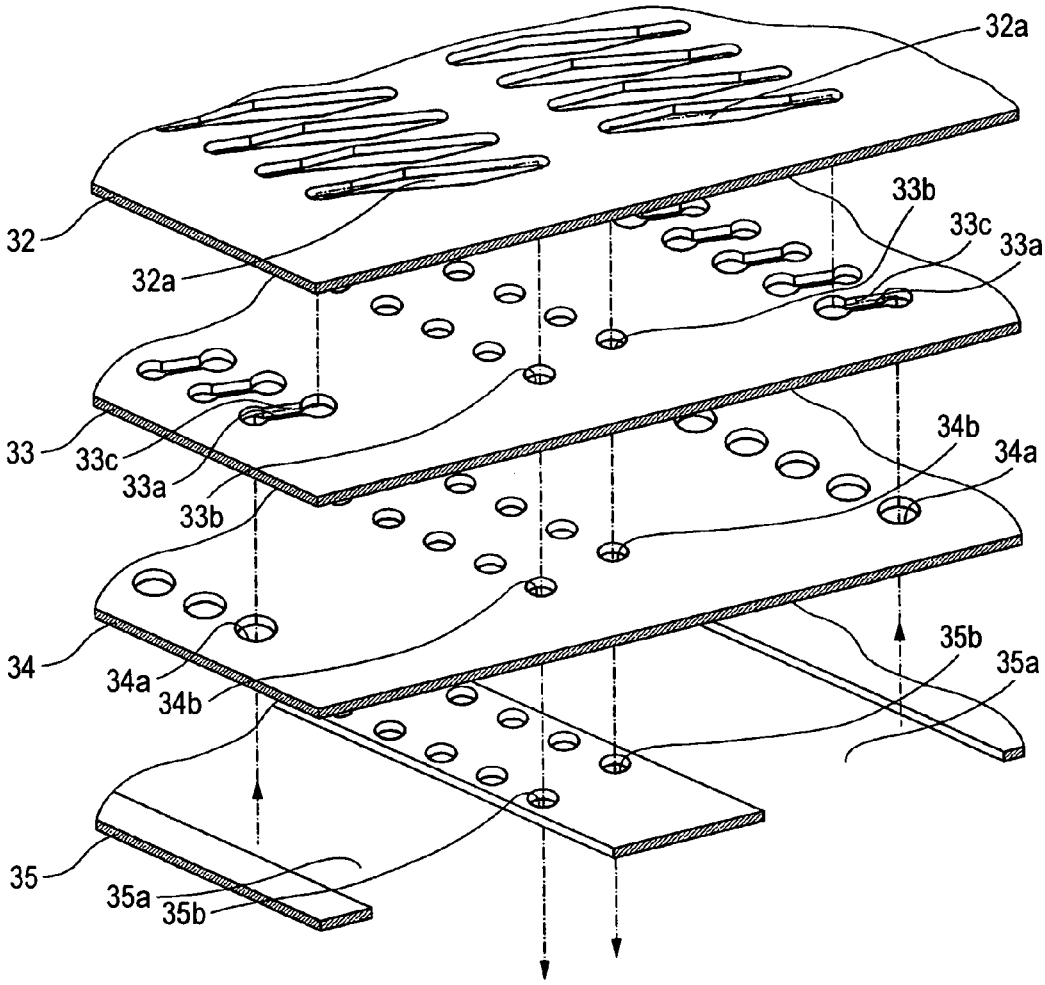
FIG. 5 is an exploded perspective view showing a part of the passage unit shown in FIG. 1.

FIG. 2 is a plan view showing a manifold plate, described later, in the passage unit 22 shown in FIG. 1. FIG. 3 is a sectional view of the ink jet head, which is taken along the line III-III of FIG. 2. FIG. 4 is a sectional view of the ink jet head, which is taken along the line IV-IV of FIG. 2. As shown in FIG. 3 and FIG. 4, the piezoelectric actuator 23 is formed by laminating a number of piezoelectric sheets 50 formed of a ceramic material of lead zirconate titanate (PZT) each having a thickness of approximately 30 μm or so, and is provided with electrodes 51 and 52 sandwiched by the piezoelectric sheets 50 alternately in the laminating direction. The electrodes 51 and 52 are disposed to correspond to respective pressure chambers 45 described later, and the electrodes 51 and the electrodes 52, alternately disposed in the laminating direction, are electrically connected to each other, respectively, and are also electrically connected to the surface electrodes (not illustrated) on the uppermost side, respectively.

As shown in FIG. 3 and FIG. 4, the passage unit 22 includes a pressure chamber plate 32, a connection passage plate 33, a spacer plate 34, a first manifold plate 35, a second manifold plate 36, a third manifold plate 37, a cover plate 38 and a nozzle plate 39 by laminating and adhering them in this order. The nozzle plate 39 is a resin sheet of polyimide, etc. The plates 32 to 38 other than the nozzle plate 39 are metal plates that are 42% nickel alloy steel plate, etc. Openings to define passages are formed in the plates 32 to 39 by electrolytic etching, laser processing, plasma jet processing, etc.

First, a brief description is given of respective configurations of the plates 32 to 39. As shown in FIG. 2 to FIG. 4, the pressure chamber plate 32 includes pressure chamber pores 32*a* juxtaposed in two rows for each of four colors (for example, black, yellow, magenta and cyan) and liquid supplying ports 32*b* provided in twos for each of four colors of ink. The pressure chamber pore 32*a* is formed to be parallelogram-shaped in its plan view, and the diagonal line extends so as to be tilted to the row direction of the pressure chamber pore 32*a*. A filter 40 (Refer to FIG. 1) that eliminates dust mixed in ink supplied from an ink tank (not illustrated) is placed on the liquid supplying port 32*b*.

The connection passage plate 33 includes a long slot-shaped connection passage pore 33*a* that communicates with one corner of the pressure chamber pore 32*a* at one end of a longer diagonal line and that extends away from the corner, and an outflow through-pore 33*b* that communicates with another corner of the pressure chamber pore 32*a* at the diagonally opposite end. The spacer plate 34 includes a communication pore 34*a* that communicates with the connection passage pore 33*a* and an outflow through-pore 34*b* that communicates with the outflow through-pore 33*b*.

The first, second and third manifold plates 35, 36 and 37 have a plurality of manifold pores 35*a*, 36*a* and 37*a* extending in the row direction for each of the rows of the pressure chamber pores 32*a*. The manifold pores 35*a*, 36*a* and 37*a* have the same shape in their plan view and are located so as to overlap each other. The manifold pores 35*a*, 36*a* and 37*a* communicate with the pressure chamber pores 32*a* of the corresponding row, located above the manifold pores 35*a*, 36*a* and 37*a*, via the connection passage pores 33*a* and the communication pores 34*a*. Therefore, the manifold pores 35*a*, 36*a* and 37*a* are arranged in two rows for each of four colors of ink.

One end part, in the extension direction, of the manifold pores 35*a*, 36*a* and 37*a* communicates with the liquid supplying pore 32*b* of the pressure chamber plate 32 via through-pores (not illustrated) formed in the connection passage plate 33 and the spacer plate 34. The other end part of the manifold pores 35*a*, 36*a* and 37*a* is connected to the connection passage 35*c*, 36*c* and 37*c* which are arcuately bent toward the adjacent manifold pores 35*a*, 36*a* and 37*a* side of the same color of ink. The connection passages 35*c*, 36*c* and 37*c* of the adjacent manifold pores 35*a*, 36*a* and 37*a* communicate with each other with their tip ends facing each other. Therefore, two manifold pores 35*a*, 36*a* and 37*a* arranged in parallel have a partition wall 48 intervened therebetween and are formed to be substantially U-shaped, including the connection pores 35*c*, 36*c* and 37*c*.

The cover plate 38 is disposed so as to cover the underside of the manifold pore 37*a*. The nozzle plate 39 is positioned below the cover plate 38 and has nozzle pores 39*a* forming a plurality of rows corresponding to the respective pressure chamber pores 32*a*. The nozzle pores 39*a* communicate with the corresponding pressure chamber pores 32*a* via the outflow through-pores 33*b*, 34*b*, 35*b*, 36*b*, 37*b* and 38*b*, which are formed in the connection passage plate 33, spacer plate 34, manifold plate 35, 36, 37 and cover plate 38. The nozzle pores 39*a* have their diameter reduced downward and each function as a nozzle 47 for ejecting ink to the outside.

Next, a brief description is given of a passage of ink in the passage unit 22. As shown in FIG. 2 to FIG. 4, since the upper and lower surfaces of the manifold pores 35*a*, 36*a* and 37*a* are covered by the spacer plate 34 and the cover plate 38, a plurality of common liquid ink chambers 41 are formed. Therefore, a common liquid chamber group 61 made up of two rows of common liquid chambers 41 are formed per color of ink.

Hereinafter, for convenience of description, one of the two common liquid chambers 41, which is placed at the left side in the plan view, included in the common liquid chamber group 61 may be called the left side common liquid chamber 41*a*, and one which is placed at the right side in the plan view (right side facing the paper of FIG. 2) may be called the right side common liquid chamber 41*b*. The left and right direction is identical to the left and right direction facing the paper of FIG. 2 to FIG. 5. The structures of the respective common liquid chamber groups 61 are similar to each other.

In the following description, a description is given of only one common liquid chamber group 61 and its related configuration, and description of the other common liquid chamber group 61 and their related configurations is omitted.

The common liquid chamber 41 extends in the row direction of pressure chambers to overlap the pressure chamber group 61 described later in the plan view, and the liquid supplying port 32*b* communicates with one end part of the common liquid chamber 41 in the extension direction. The other end part of the common liquid chamber 41 is connected to a connection passage 43 that is formed by covering the upper and lower surfaces of the connection passages 35*c*, 36*c* and 37*c* with the spacer plate 34 and the cover plate 38. The connection passage 43 is connected to a connection passage 43 that is connected to another common liquid chamber 41 included in the common liquid chamber group 61. Hereinafter, there may be cases where the connection passage 43 connected to the left side common liquid chamber 41*a* is called the left side connection passage 43*a*, and the connection passage 43 connected to the right side common liquid chamber 41*b* is called the right side connection passage 43*b*. A common passage 63 that is semi-circular in its plan view and causes two common liquid chambers 41*a* and 41*b* to communicate with each other is formed by the two connection passages 43*a* and 43*b* thus connected. The end part of the partition wall 48 forms an inner wall surface (inner circumferential surface) 63*b* of the common passage 63. The inner circumferential surface 63*b* is continued to inner wall surfaces (inner side wall surfaces) of the left and right common liquid chambers 41. Another inner wall surface (outer circumferential surface) 63*a* of the common passage 63 is continued to inner wall surfaces (outer side wall surfaces) of the left and right common liquid chambers 41. Two common liquid chambers 41*a* and 41*b* thus formed present a substantially U-shape in its plan view, including the common passage 63.

The pressure chamber 45 is formed by covering the upper and lower surfaces of the pressure chamber pore 32*a* with the piezoelectric actuator 23 and the spacer plate 33. The common liquid chamber 41 communicates with the pressure chambers 45 of the corresponding row by a plurality of crank-shaped connection passages 42. The connection passage 42 is formed by the communication pore 34*a* of the spacer plate 34 and the connection passage pore 33*a* of the connection passage plate 33. The resistance of the connection passage 42 is larger than the resistance of the outflow passage 44 described later, thereby preventing a reverse flow from the pressure chamber 45 to the connection passage 42. To this end, the sectional area of the connection passage 42 is smaller than the sectional area of the outflow passage 44.

The pressure chambers 45 are arranged in two rows for each of the four colors of ink as described above, and the pressure chambers 45 of each row form a pressure chamber group 65. The common liquid chamber 41 is provided for each pressure chamber group 65. The outflow passage 44 is formed by the outflow through-pores 33*b*, 34*b*, 35*b*, 36*b*, 37*b* and 38*b*.

According to the ink jet head 21 thus constructed, ink supplied from an ink tank (not illustrated) via the filter 40 is filled in the common liquid chambers 41, connection passages 42, pressure chambers 45 and outflow passages 44. When voltage is selectively applied between a plurality of electrodes 51 and 52 corresponding to the upper part of the pressure chamber 45 in this state, an electric field acts on active parts of the respective piezoelectric sheets 50 placed therebetween, whereby distortional deformation occurs in the laminating direction. Herein, the active part is a part of the piezoelectric sheets 50, which is placed between the electrodes 51 and 52 and which causes distortional deformation in the laminating direction as described above. Since the active part is deformed, ink in the interior of the pressure chamber 45 is ejected outwardly from the nozzle 47 through the outflow passage 44.

In the following, a further detailed description is given of the common passage 63. Two common liquid chambers 41*a* and 41*b* included in the common liquid chamber group 61 are juxtaposed to each other in a direction perpendicular to the extension direction, and are arranged to be left/right symmetrical around a virtual center surface 66 passing parallel thereto at the intermediate part therebetween. On the contrary, the common passage 63 is formed to be left/right asymmetrical with respect to the virtual center surface 66. In the present example, two connection passages 43*a* and 43*b* connected to each other are offset in the extension direction.

That is, the right side part 63*b*3 (one side of the right side connection passage 43*b*) of the inner wall surface 63*b* at the inner circumferential side of the common passage 63, i.e. the right side of the tip end of the partition wall 48, is bent toward the left connection passage 43*a* to be arc-shaped, the radius of which is substantially one-half the width 48*w* (the width in the direction orthogonal to the extension direction of the common liquid chambers 41) of the partition wall 48. The left side part (one side of the left side connection passage 43*b*) of the inner wall surface 63*b*, i.e. the left side of the tip end of the partition wall 48, has: an arc-shaped portion 63*b*1 that extends from a position offset toward the liquid supplying port 43 side from the right part 63*b*3 in the extension direction and that is convex into the connection passage 43*a*; and an arc-shaped portion 63*b*2 that is continuous from the arc-shaped portion 63*b*1 and that is concave away from the connection passage 43*a*. The right side arc-shaped portion 63*b*3 and the left side arc-shaped portion 63*b*2 are connected to each other with an appropriate arcuate surface 63*b*AP at the tip end of the partition wall 48. The curvature of the arcuate surface 63*b*AP is larger than the curvature of an arc the diameter of which is the width 48*w* of the partition wall 48. Here, the term "curvature" means the rate of change of the unit tangent vector to a curve with respect to arc length of the curve.

The left side part 63*a*1 of the inner wall surface 63*a* at the outer circumferential side of the common passage 63 is offset toward the liquid supplying port 43 side from the right side part 63*a*2 in the extension direction. The parts 63*a*1 and 63*a*2 are respectively continued, at one-end sides thereof, to the side surfaces of the common liquid chambers 41*a* and 41*b* with arcuate surfaces, and are continued to each other at the other end sides with a stepped surface 63*a*3 located substantially on the virtual center surface 66. The two connection passages 43*a* and 43*b* have substantially the same shape in their plan views excepting the portions corresponding to the arcuate portion 63*b*2, and the cross-sections of the passages have substantially the same shape. The arcuate surfaces of the respective portions may be a part of an accurate circle, or otherwise may be smoothly changing curved surfaces.

The common passage 63 has a discharge port 67 that is formed in the vicinity of the virtual center surface 66 and that is located at the position farthest apart from the ink supplying ports 32 in its plan view. In the present example, the discharge port 67 is located at the position along the inner wall surface 63*a* at the outer circumferential side of the common passage 63 and adjacent to the stepped surface 63*a*3.

The discharge port 67 passes through the spacer plate 34 to be open to the common passage 63. The discharge port 67 is also open to the outside of the passage unit 22 via the discharge passage 68. The discharge passage 68 has a groove-like shape formed between the connection passage plate 33 and the spacer plate 34, one end of which is connected to the discharge port 67, and the other end of which is open to the lower surface of the nozzle plate 39 via a through-pore 68*a* passing through the plates 34 to 39 in the laminating direction. The through-pore 68*a* at the nozzle plate 39 is positioned so that a suction cap can simultaneously cover the through-pore 68*a* and the nozzles 47.

The resistance of the discharge passage 68 including the discharge port 67 and the through-pore 68*a* is smaller than the resistance of the ejection passage connecting the common liquid chamber 41 and the nozzle 47 together via the pressure chamber 45. Therefore, if negative pressure is given to the through-pore 68*a* and the nozzle 47 through the suction cap, ink flows with priority toward the discharge port 67 in the common liquid chamber 41 when supplying ink from an ink tank to the common liquid chamber 41 via the liquid supplying port 32*b*. The discharge port 67 may be located in the cover plate 38 or may be open at a part of the plates 34 to 38, which forms the inner surface of the common passage 63.

Figure 6:
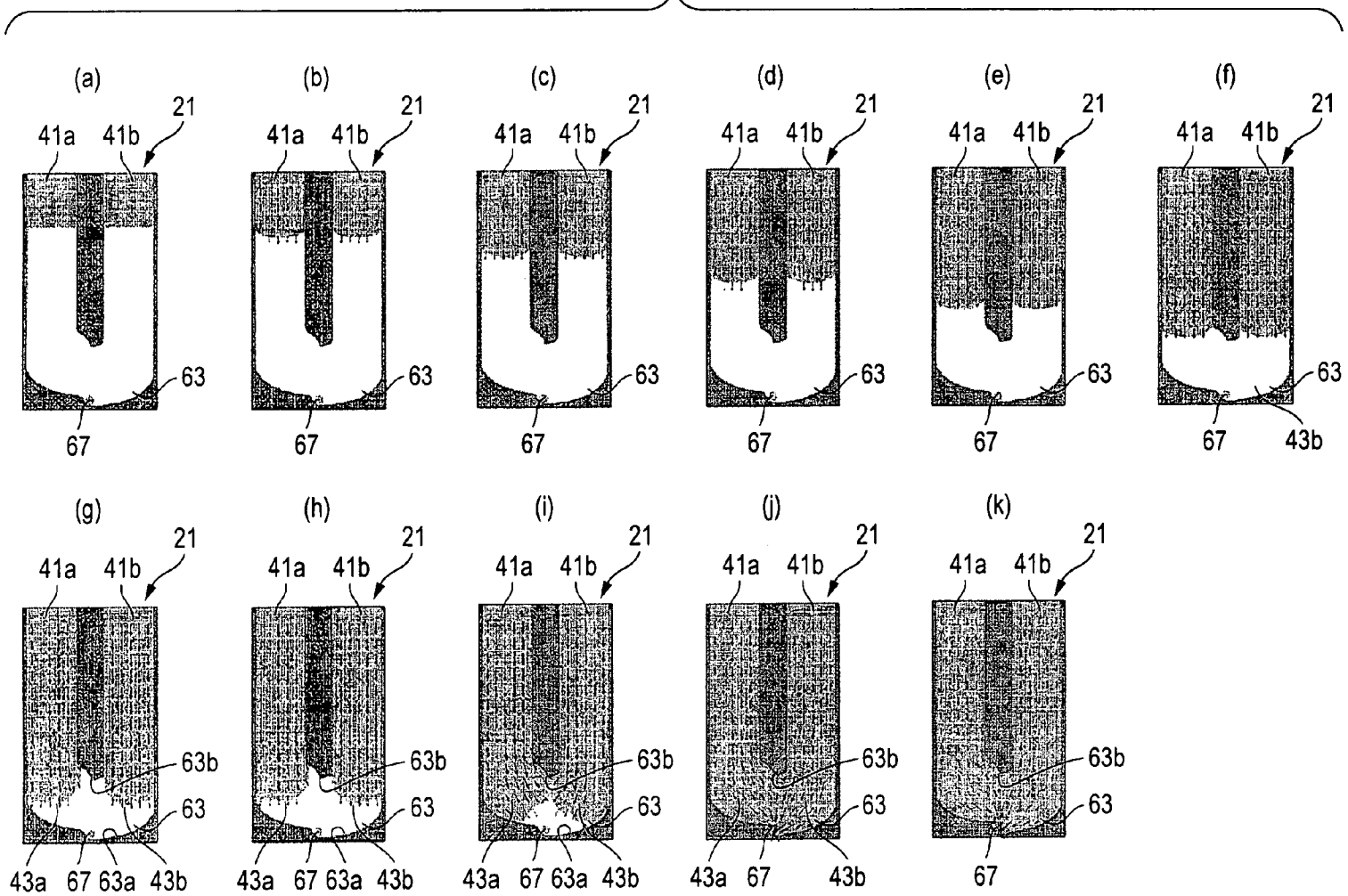
FIG. 6 shows chronological changes of ink flows in the ink jet head, which are obtained by simulating ink flows in the common ink chamber group and the common passages.
Figure 7:
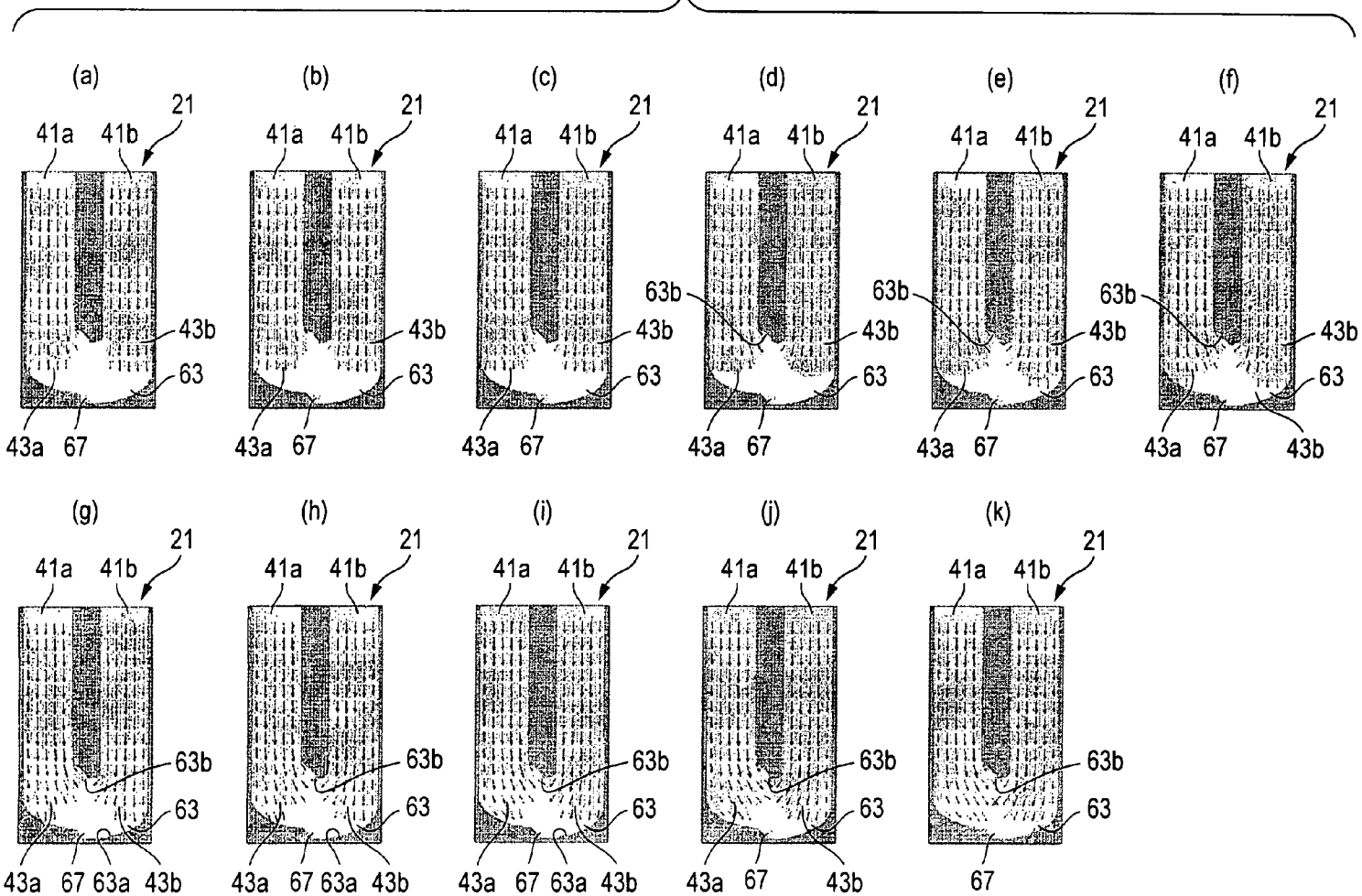
FIG. 7 is a view further showing a part of FIG. 6 in detail.
Figure 8:
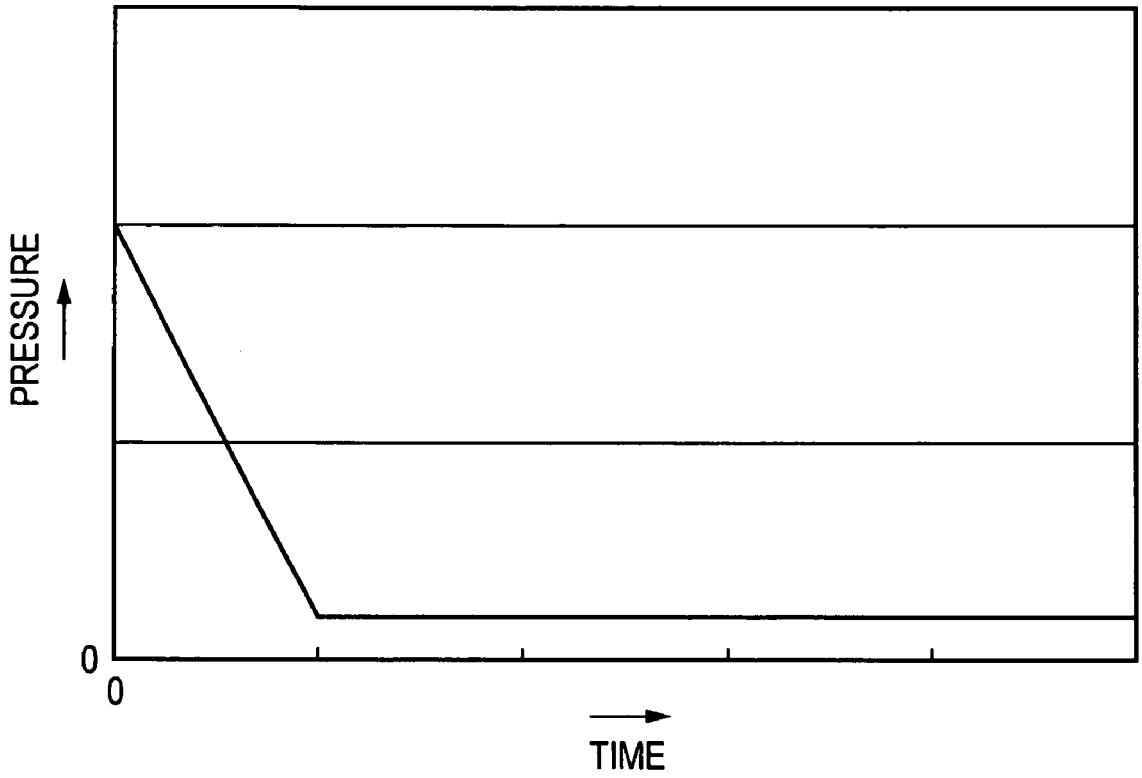
FIG. 8 is a graph showing chronological changes in pressure given to the discharge port 67.

FIG. 6 shows chronological changes of ink flows, which were obtained through simulation of ink flows when supplying ink into the common ink chamber group 61 and the common passage 63. FIG. 7 shows in further detail the simulation results immediately before inks join together. FIG. 8 is a graph showing chronological changes of pressure given to the discharge port 67. The simulation was carried out in regard to a case where negative pressure is given to the discharge port 67 while making fixed the pressure acting on the two liquid supplying ports 32*b* (not illustrated in FIG. 6), the pressure is gradually changed from time 0 milliseconds and is kept fixed when the pressure reaches a predetermined value (Refer to FIG. 8). In FIG. 8, the vertical axis shows pressure, and the horizontal axis shows elapsed time.

FIG. 6(*a*) shows a state of ink at time 0 milliseconds when ink supply from the liquid supplying ports 32*b* is commenced, and FIGS. 6(*b*), (*c*), (*d*), (*e*), (*f*), (*g*), (*h*), (*i*), (*j*) and (*k*) respectively show a state of ink at 3.0 milliseconds, 4.0 milliseconds, 5.0 milliseconds, 6.0 milliseconds, 7.0 milliseconds, 7.5 milliseconds, 8.0 milliseconds, 8.5 milliseconds, 9.0 milliseconds, and 12.0 milliseconds after ink supply from the liquid supplying ports 32*b* is commenced. FIGS. 7(*a*), (*b*), (*c*), (*d*), (*e*), (*f*), (*g*), (*h*), (*i*), (*j*) and (*k*) respectively show a state of ink at 8.0 milliseconds, 8.1 milliseconds, 8.2 milliseconds, 8.3 milliseconds, 8.4 milliseconds, 8.5 milliseconds, 8.6 milliseconds, 8.7 milliseconds, 8.8 milliseconds, 8.9 milliseconds and 9.0 milliseconds after ink supply from the ink supplying port 32*b* is commenced. Referring to the simulation results, a description is given of actions of filling ink in the ink jet head 21.

If negative pressure is given to the nozzles 47 and the through-pore 68*a* of the discharge passage 68 via the suction cap covering the nozzles 47 and the through-pore 68*a* in a state where the liquid supplying ports 32*b* are connected to an ink tank (not illustrated), ink is sucked from the ink tank and is supplied to the liquid supplying ports 32*b* (Refer to FIG. 6(*b*)). Further, if negative pressure is continuously given to the nozzles 47 and the discharge passage 68, ink flows along the inner walls of the common liquid chambers 41*a* and 41*b* and reaches the connection passages 43*a* and 43*b* (Refer to FIG. 6(*c*) to (*f*)). Ink attempts to flow in the extension direction of the common liquid chambers 41*a* and 41*b* in the connection passages 43*a* and 43*b* and once reaches the position beyond the inner wall surface 63*b* at the inner circumferential side (Refer to FIG. 6(*g*) to (*h*)).

After that, ink spreads toward the inner wall surface 63*b* at the inner circumferential side, and the ink flown near the partition wall 48 from the right-side common liquid chamber 41*b* flows along the right-side arcuate part 63*b*3 of the partition wall 48 and is oriented to the tip end thereof. Further, ink flown near the partition wall 48 from the left-side common liquid chamber 41*a* further flows along the left-side arcuate parts 63*b*1 and 63*b*2 of the partition wall 48 and is oriented to the tip end thereof. Ink in the vicinity of both sides of the partition wall 48 join at the tip end of the inner wall surface 63*b*, and ink at the portion apart from the partition wall reaches the discharge port 67 while filling the space at the inner wall surface 63*a* of the outer circumferential side.

Since the curvature of the curved surface 63*b*AP connecting the right-side arcuate portion 63*b*3 and the left-side arcuate portion 63*b*2 at the tip end of the above-described partition wall 48 is larger than the curvature of an arc the diameter of which is the width 48*w* of the partition wall 48, ink flowing along the right-side arcuate portion 63*b*3 and ink flowing along the left-side arcuate portion 63*b*2 meet together without leaving any spacing at the tip end of the partition wall 48 (or while preventing the possibility thereof). This way, the possibility that air bubbles may stagnate can be significantly reduced. The arcuate portions 63*b*1 and 63*b*2 at the left-side portion at the inner wall surface 63*a* are contoured to present a convex-concave shape with small change. This way, the arcuate portions 63*b*1 and 63*b*2 can be brought into contact with ink in compliance with the spreading of ink.

Since the right-side connection passage 43*b* is connected to the left-side connection passage 43*a* with an offset positional relationship, ink flows of the respective connection passages 43*a* and 43*b* join together in an asymmetrical state. Therefore, irregular flows such as vortex flows are generated at the virtual center surface 66, which is a point of junction, and in the vicinity thereof. By generating such flows, air bubbles are caused to flow without stagnating and can be guided to the discharge port 67, whereby it is possible to further prevent air bubbles from being left over.

In case where ink is supplied with negative pressure given to the nozzles 47 and through-pore 68*a* as described above, ink is filled to the nozzles 47 and through-pore 68*a*. Ink in the through-pore 68*a* forms a meniscus as well as ink in the nozzles 47, and this state is maintained while ink is being ejected from the nozzles 47.

Since air bubbles are prevented from being left over in the common passage 63, it is possible to eliminate defective ejection of ink resulting from the stagnating air bubbles, thereby exhibiting satisfactory ejection performance. Also, if the shapes and sections of the connection passages 43*a* and 43*b* are substantially the same although the connection passages 43*a* and 43*b* are connected to each other with offset, a plurality of nozzles 47 connected to each of the left-side common ink chamber 41*a* and the right-side common ink chamber 41*b* can have the same ejection performance. Therefore, the ink jet head 21 can eliminate defective ejection, while maintaining uniform printing quality between pixels.

EXAMPLE 2

Figure 9:
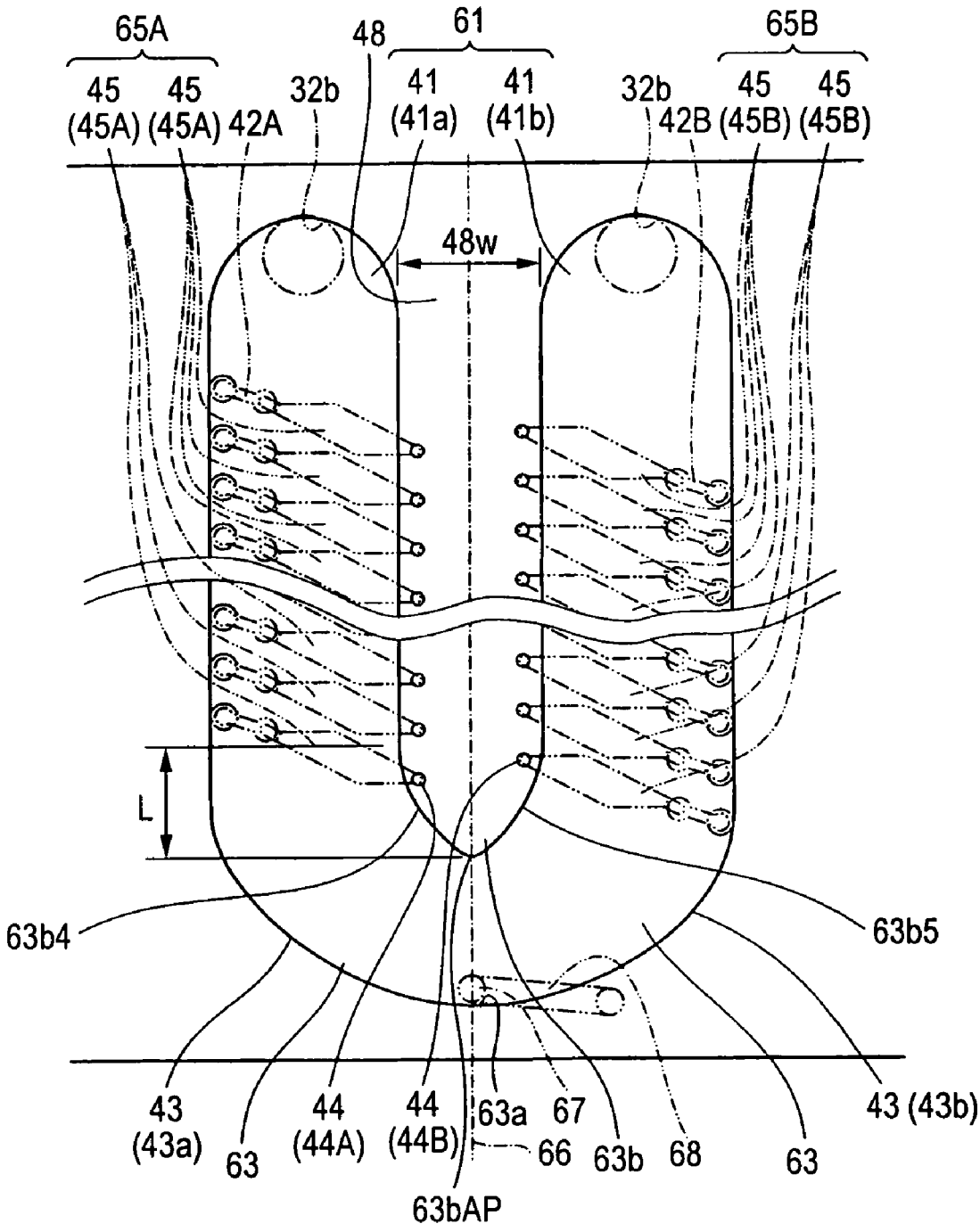
FIG. 9 is a plan view of a manifold plate according to Example 2.

FIG. 9 is a plan view showing a manifold plate according to Example 2. Configurations similar to those of Example 1 are given the same reference numerals, and description thereof is omitted. In the present example, the left-side connection passage 43*a* and the right-side connection passage 43*b* are arranged substantially in alignment with each other without such offset as in Example 1. In this example, side surfaces 63*b*4 and 63*b*5 of the partition wall 48 in the connection passages 43 are formed so that the partition wall 48 is tapered to narrow the width of the partition wall 48 toward the tip end position. In further detail, a range L where each of the side surfaces 63*b*4 and 63*b*5 is bent to be arc-shaped, i.e. a length L of the each of the side surfaces 63*b*4 and 63*b*5 as measured in the extension direction to the tip end position of the partition wall 48 where the side surfaces 63*b*4 and 63*b*5 are connected to each other via an appropriate curved surface 63*b*AP, is longer than one-half the width 48*w* of the partition wall. Since the curvature of the curved surface 63*b*AP connecting the sides 63*b*4 and 63*b*5 at the tip end of the partition wall 48 is larger than the curvature of an arc the diameter of which is the width 48*w* of the partition wall 48, ink flowing along the side 63*b*4 and ink flowing along the side 63*b*5 can meet together without leaving any spacing at the tip end of the partition wall 48 (or preventing the possibility thereof), and therefore a possibility that air bubbles may stagnate can be remarkably reduced.

EXAMPLE 3

Figure 10:
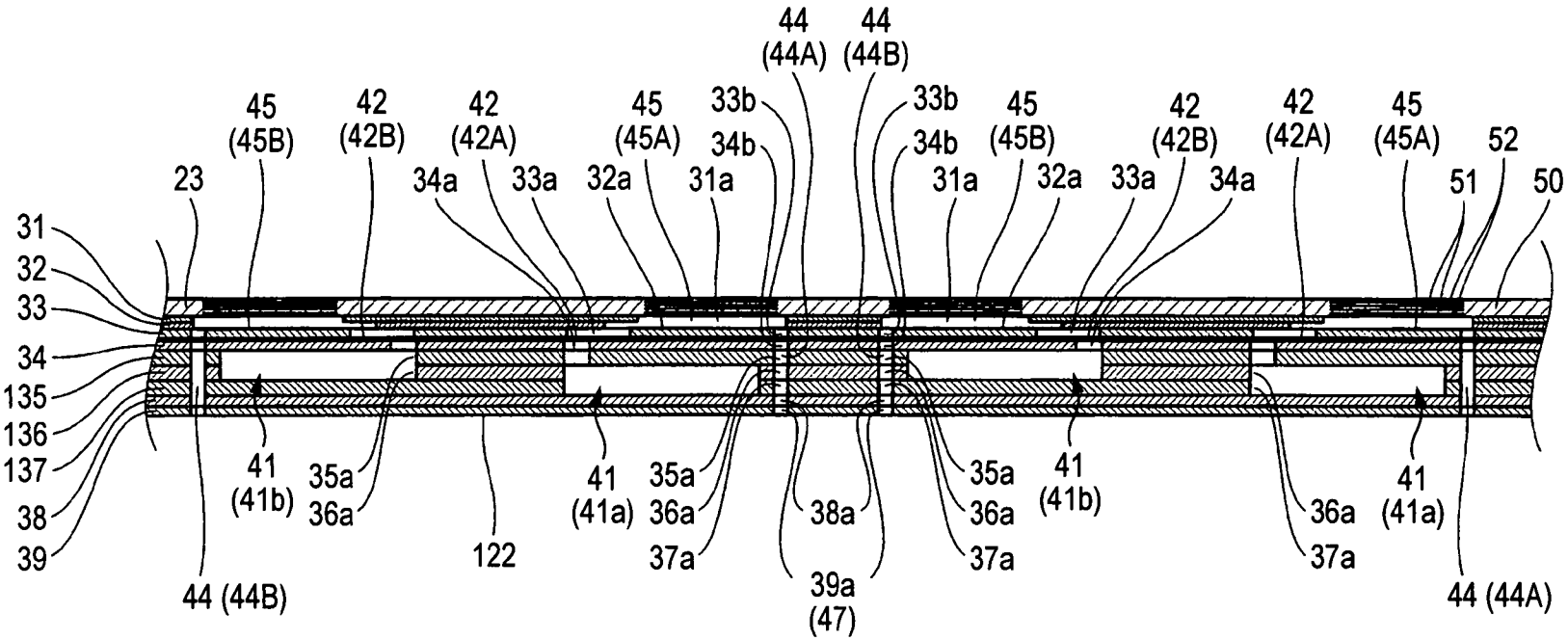
FIG. 10 is a sectional view of an ink jet head corresponding to the position of line III-III of FIG. 2, according to Example 3.
Figure 11:
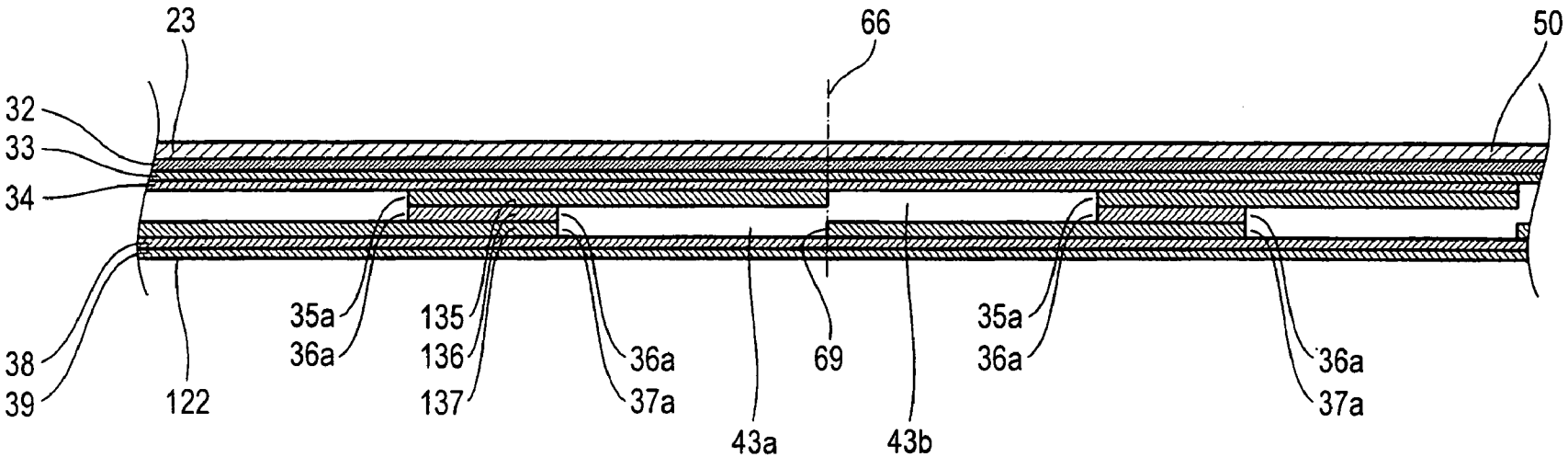
FIG. 11 is a sectional view of an ink jet head corresponding to the position of line IV-IV of FIG. 2, according to Example 3, which is a sectional view taken along the line X-X in FIG. 10, also showing a piezoelectric actuator 23.
Figure 12:
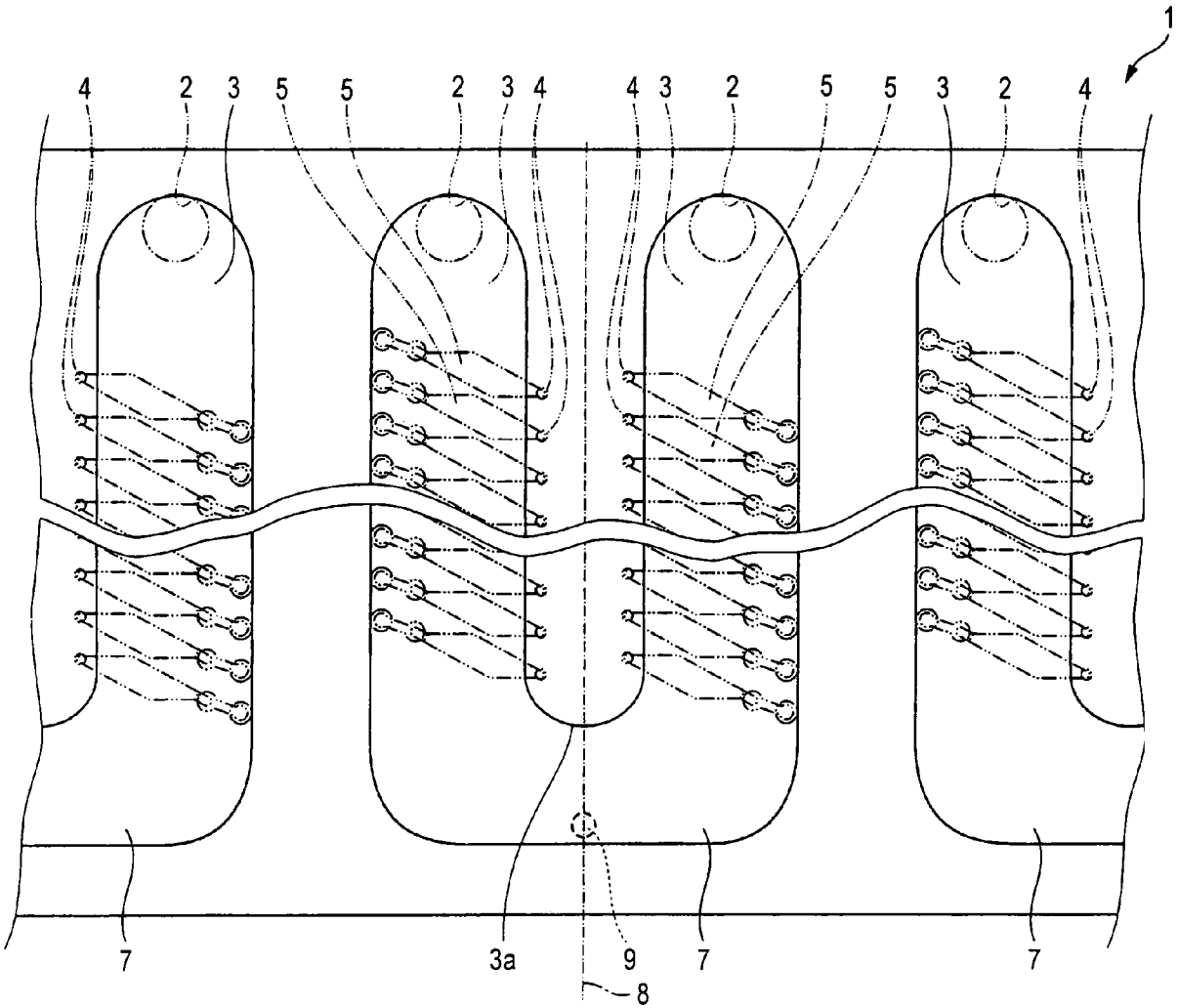
FIG. 12 is a plan view showing a manifold plate of an prototype ink jet head.
Figure 13:
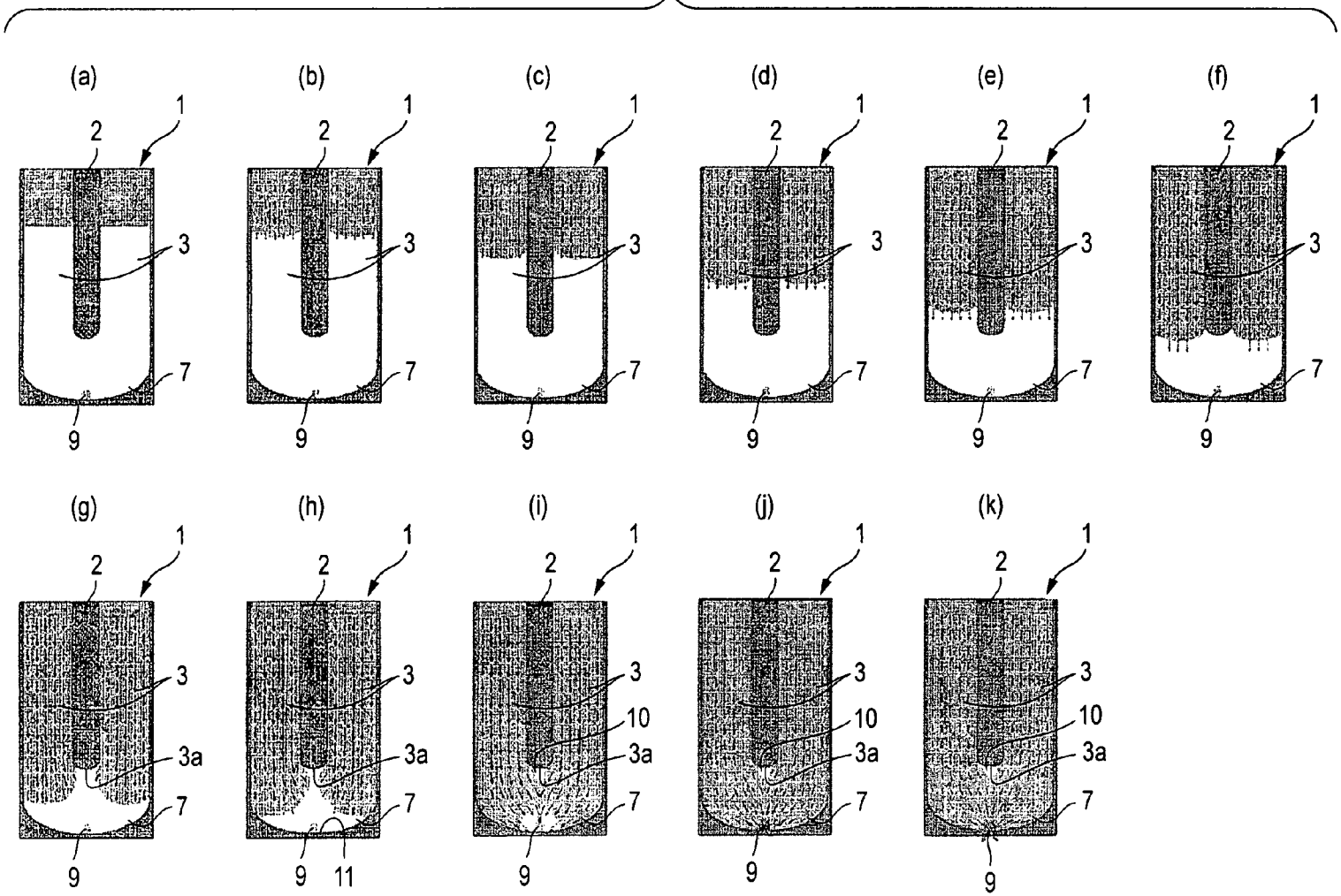
FIG. 13 is a view showing chronological changes in ink flows in the prototype ink jet head.

FIG. 10 and FIG. 11 show Example 3. The plan views showing a manifold plate in Example 3 are drawn as in FIG. 2. FIG. 10 and FIG. 11 correspond to sectional views showing an ink jet head, which are taken along the lines III-III and IV-IV in FIG. 2, respectively. Configurations of a passage unit 122 according to Example 3, which are similar to those of the passage unit 22 according to Example 1 are given the same reference numerals, and description thereof is omitted.

As shown in FIGS. 10 and FIGS. 11, a difference between Example 3 and Example 1 or 2 is that the passage unit 122 has the left-side common liquid chamber 41*a* offset downward from the right-side common liquid chamber 41*b*. The left-side connection passage 43*a* is correspondingly offset downward from the right-side connection passage 43*b*. Therefore, as shown in FIGS. 11, the left-side connection passage 43*a* and the right-side connection passage 43*b* are connected to each other with an offset positional relationship in the depth direction (downward) of the common liquid chamber 41, and a stepped portion 69 is formed at the connection portion where the connection passages 43*a* and 43*b* are connected to each other.

In line with such a configuration, in the first manifold plate 135, the first manifold pore 35*a* is formed at the position corresponding to the right-side common liquid chamber 41*b*, and the first connection pore 35*c* is formed at the position corresponding to the right-side connection passage 43*b*. Furthermore, the first manifold plate 135 further includes outflow through-pores 35*b* communicating with the outflow through-pores 34*b*, respectively.

In the second manifold plate 136, the second manifold pore 36*a* is formed at the positions corresponding to the respective common liquid chambers 41*a* and 41*b*, and the second connection pore 36*c* is formed at the position corresponding to the respective connection passages 43*a* and 43*b*. The second manifold plate 136 further includes outflow through-pores 36*b* respectively communicating with the outflow through-pores 35*b*.

In the third manifold plate 137, the third manifold pore 37*a* is formed at the position corresponding to the left-side common liquid chamber 41*a*, and the third connection pore 37*c* is formed at the position corresponding to the left-side connection passage 43*a*. Further, the third manifold plate 137 further includes outflow through-pores 37*b* respectively communicating with the outflow through-pores 36*b*. And, a plurality of right-side common liquid chambers 41*b* and right-side connection passages connected thereto are formed by the first manifold plate 135 and the second manifold plate 136, and a plurality of left-side common liquid chambers 41*a* and left-side connection passages 43*b* connected thereto are formed by the second manifold plate 136 and the third manifold plate 137.

Thus, since the left-side and right-side common liquid chambers 41*a*, 41*b* and the left-side and right-side connection passages 43*a*, 43*b* are offset in the vertical direction and arranged asymmetrically, irregular flows can be generated in the vicinity of the position where inks flowing from both common liquid chambers 41*a* and 41*b* join together, whereby air bubbles in the common passage 63 are caused to flow without stagnating and can be guided to the discharge port 67.

In the examples discussed above, a description is given of a case where the common ink chamber group 61 is made up of two common liquid chambers 41. However, the number of common liquid chambers 41 included in the common liquid chamber group 61 may be four, six, eight or 2n (n is an integral number). The common liquid chambers 41 may be juxtaposed by the same number at one side and the other side of the virtual center surface, and common passages 63 respectively connected to a plurality of common liquid chambers 41 may be formed asymmetrically with respect to the virtual center surface. The common passages 63 may be formed by not only a combination of arcuate curved surfaces as shown in FIG. 2 but also a combination of various types of curved surfaces.

The examples described above are those in which the present invention is applied to an ink jet. However, the invention may be applicable to an apparatus for manufacturing a color filter for a liquid crystal apparatus by ejecting a liquid other than ink, for example, a coloring liquid, and a liquid ejection apparatus used for an apparatus for forming electrical wiring by ejecting a conductive liquid, to provide similar effects.

A piezoelectric actuator is used as means for generating pressure fluctuations. However, an actuator that fluctuates by static electricity may be used.

As discussed above, the present invention can provide at least the following illustrative, non-limiting embodiments.

(1) A liquid ejection apparatus, including: plural nozzles for ejecting liquid therefrom; plural pressure chamber groups, each group including plural pressure chambers, the pressure chambers of the plural pressure chamber groups respectively communicating with the plural nozzles to eject the liquid from the plural nozzles by pressure fluctuations; a common liquid chamber group including plural common liquid chambers, each of the plural common liquid chambers being provided for and connected to the plural pressure chambers of a respective one of the pressure chamber groups, and being supplied with the liquid to be ejected from the nozzles communicating with the pressure chambers of the respective one of the pressure chamber groups; liquid supplying ports respectively connected to one ends of the common liquid chambers to supply the liquid to the common liquid chambers; a common passage including plural connection passages respectively extending from other ends of the common liquid chambers and connected to one another; and a discharge port formed in the common passage and opened to the exterior; wherein the common liquid chambers adjacent to each other and the connection passages extending from the adjacent common liquid chambers are separated by a partition wall, the partition wall having a first side surface and a second side surface opposite the first side surface, the first side surface defining one of side surfaces of the common chamber and one of side surfaces of the connection passage extending from the common chamber, the second side surface defining one of side surfaces of the other common chamber and one of side surfaces of the other connection passage extending from the other common chamber; and the partition wall has a curved surface connecting the first side surface to the second side surface in a vicinity of a position where the connection passages having the partition wall placed therebetween are connected to each other, and a curvature of the curved surface is larger than a curvature of an arc having a diameter equal to a width of the partition wall.

According to the apparatus of (1), when the pressure of the nozzles and the discharge port is made lower than the pressure of the liquid supplying ports, liquid is supplied from the liquid supplying ports to the common liquid chambers to flow toward the other ends in the common liquid chambers. Liquid that reaches the other ends of the common liquid chambers further flows in the connection passages extending from the other ends, and finally liquid that has flown from one common liquid chamber and liquid that has flown from another common liquid chamber meet together. Since the curvature of the curved surface connecting the first side surface to the second side surface in a vicinity of a position where the connection passages are connected to each other is larger than the curvature of an arc having the diameter equal to the width of the partition wall, liquid that has flown through the one common liquid chamber and liquid that has flown through the other common liquid chamber are made close to each other while preventing spacing from remaining between the liquid and the partition wall, and join together. Accordingly, it is possible to prevent air bubbles from being left over in the common passages, and defective ejection of nozzles resulting from air bubbles can be prevented from occurring.

(2) The apparatus of (1), in which the common liquid chambers extend parallel to each other in one direction, and are formed to be U-shaped, including the common passage.

According to the apparatus of (2), when liquid is supplied from the liquid supplying ports, liquid flowing in the connection passages flows quicker at the inside than at the outside in the common passage and joins together sooner at the inside than at the outside. Since liquid is caused to join as described above along the partition wall at the inside, few air bubbles remain on the inside.

(3) The apparatus of (2), in which the discharge port is located at a position which is on or in the vicinity of an extension of the partition wall and separated the furthest from the liquid supplying ports in the common liquid passage.

According to the apparatus of (3), the discharge port is formed at the position separated the furthest from the liquid supplying ports on or in the vicinity of the extension of the partition wall. The position separated the furthest from the liquid supplying ports on or in the vicinity of the extension of the partition wall means a position where liquid flowing through the connection passages join together and the liquid surface of the joined liquid finally reaches. Therefore, all of the air in the common liquid chambers and common passages is discharged through the discharge port by the liquid. Accordingly, air bubbles are prevented from remaining in the common liquid chambers and common passages, and it is possible to prevent defective ejection of nozzles resulting from the air bubbles.

(4) The apparatus of any one of (1) to (3), in which, an even number of the plural common liquid chambers are arrayed in a direction perpendicular to a virtual center surface so that the same number of the common liquid chambers are arranged at both sides with respect to the virtual center surface, and a portion of the common passage, which extends at least along the partition wall is asymmetrical with respect to the virtual center surface.

According to the apparatus of (4), since the common passage is asymmetrical with respect to the virtual center surface, liquid joining together in the common passage generates irregular flows in the vicinity of the virtual center surface. The irregular flows can move air bubbles produced in the common passage to be finally discharged through the discharge port. Accordingly, it is possible to prevent air bubbles from remaining in the common passages, and possible to prevent defective ejection of nozzles from occurring due to air bubbles.

(5) The apparatus of (4), in which one of the connection passages, included in the common passage and connected to another one of the connection passages, is offset in at least one direction relative to the other one of the connection passages.

According to the apparatus of (5), since the one connection passage is connected to the other connection passage with offset in one direction, irregular flows as described above can be generated when the liquid join together, thereby facilitating discharge of air bubbles.

(6) The apparatus of (4) or (5), in which one of the connection passages, included in the common passage and connected to another one of the connection passages, is offset at least in a depth direction of the common liquid chamber relative to the other one of the connection passages.

According to the apparatus of (6), since the one connection passage is connected to the other connection passage with offset in the depth direction, irregular flows as described above are generated when the liquid join together, thereby facilitating discharge of air bubbles.

(7) The apparatus of any one of (1) to (3), in which the first and second side surfaces of the partition wall are tapered toward a tip end position of the partition wall, at which the connection passages are connected to each other, and each of the first and second side surfaces extends in a range longer than one half the width of the partition wall.

According to the apparatus of (7), liquid that has flown through one common liquid chamber and liquid that has flown through another common liquid chamber can be made close to each other along the side surfaces of the partition wall to join together while preventing spacing from remaining between the liquid and the partition wall. Therefore, air bubbles can be prevented from remaining in the common passage, and defective ejection of nozzles resulting from air bubbles can be prevented from occurring.

(8) The apparatus of any one of (1) to (7), in which the plural connection passages has a substantially same flow passage sectional shape.

According to the apparatus of (8), since the sectional shapes of the connection passages are identical to each other, it is possible to prevent the state of liquid in one common liquid chamber from differing from the state of liquid in another common liquid chamber. Accordingly, liquid can be uniformly and stably ejected from plural nozzles.

(9) The apparatus of any one of (1) to (8), in which the discharge port is opened to the outside via a discharge passage, and a flow passage resistance of the discharge passage is smaller than a flow passage resistance of an ejection passage connecting the common liquid chamber via the pressure chamber to nozzle.

According to the apparatus of (9), since the flow passage resistance of the discharge passage is smaller than the flow passage resistance of the ejection passage, it is possible to facilitate discharge of air bubbles from the discharge passage, and therefore it is possible to prevent defective ejection of nozzles from occurring due to air bubbles remaining in the common liquid chamber.

What is claimed is:

1. A liquid ejection apparatus, comprising:

plural nozzles for ejecting liquid therefrom;

plural pressure chamber groups, each group including plural pressure chambers, the pressure chambers of the plural pressure chamber groups respectively communicating with the plural nozzles to eject the liquid from the plural nozzles by pressure fluctuations;

a common liquid chamber group including plural common liquid chambers, each of the plural common liquid chambers being provided for and connected to the plural pressure chambers of a respective one of the pressure chamber groups, and being supplied with the liquid to be ejected from the nozzles communicating with the pressure chambers of the respective one of the pressure chamber groups;

liquid supplying ports respectively connected to one ends of the common liquid chambers to supply the liquid to the common liquid chambers;

a common passage including plural connection passages respectively extending from other ends of the common liquid chambers and connected to one another; and a discharge port formed in the common passage and opened to the exterior;

wherein the common liquid chambers adjacent to each other and the connection passages extending from the adjacent common liquid chambers are separated by a partition wall, the partition wall having a first side surface and a second side surface opposite the first side surface, the first side surface defining one of side surfaces of the common chamber and one of side surfaces of the connection passage extending from the common chamber, the second side surface defining one of side surfaces of the other common chamber and one of side surfaces of the other connection passage extending from the other common chamber; and the partition wall has a curved surface connecting the first side surface to the second side surface in a vicinity of a position where the connection passages having the partition wall placed therebetween are connected to each other, and a curvature of the curved surface is larger than a curvature of an arc having a diameter equal to a width of the partition wall.

2. The liquid ejection apparatus according to claim 1, wherein the common liquid chambers extend parallel to each other in one direction and are formed to be U-shaped, including the common passage.

3. The liquid ejection apparatus according to claim 2, wherein the discharge port is located at a position which is on or in a vicinity of an extension of the partition wall and separated the furthest from the liquid supplying ports in the common passage.

4. The liquid ejection apparatus according to claim 1, wherein an even number of the plural common liquid chambers are arrayed in a direction perpendicular to a virtual center surface so that the same number of the common liquid chambers are arranged at both sides with respect to the virtual center surface, and a portion of the common passage, which extends at least along the partition wall is asymmetrical with respect to the virtual center surface.

5. The liquid ejection apparatus according to claim 4, wherein one of the connection passages, included in the common passage and connected to another one of the connection passages, is offset in at least one direction relative to the other one of the connection passages.

6. The liquid ejection apparatus according to any one of claims 4, wherein one of the connection passages, included in the common passage and connected to another one of the connection passages, is offset at least in a depth direction of the common liquid chamber relative to the other one of the connection passages.

7. The liquid ejection apparatus according to claim 1, wherein the first and second side surfaces of the partition wall are tapered toward a tip end position of the partition wall, at which the connection passages are connected to each other, and each of the first and second side surfaces extends in a range longer than one half the width of the partition wall.

8. The liquid ejection apparatus according to claim 1, wherein the plural connection passages has a substantially same flow passage sectional shape.

9. The liquid ejection apparatus according to claim 1, wherein the discharge port is opened to the outside via a discharge passage, and a flow passage resistance of the discharge passage is smaller than a flow passage resistance of an ejection passage connecting the common liquid chamber via the pressure chamber to the nozzle.

10. A liquid ejection apparatus comprising:

nozzles arrayed into first and second rows;

first and second pressure chambers, wherein the first pressure chambers are respectively in communication with the nozzle of the first row and the second pressure chambers are respectively in communication with the nozzles of the second row;

first and second common chambers, wherein the first common chamber is in communication with each of the first pressure chambers and the second common chamber is in communication with each of the second pressure chambers;

first and second liquid supplying ports, wherein the first liquid supplying port is in communication with the first common chamber at a first end of the first common chamber and the second liquid supplying port is in communication with the second common chamber at a first end of the second common chamber;

a partition wall located between, extending along and partially defining the first and second common chambers, wherein the partition wall has a tip end located opposite from the first ends of the first and second common chambers; and a common passage in fluid communication with each of the first and second common chamber and including first and second connection passages, wherein the first connection passage extends from a second end, opposite from the first end, of the first common chamber, the second connection passage extends from a second end, opposite from the first end, of the second common chamber, and the first and second connection passages extend along and are partially defined by the partition wall to meet together at the tip end of the partition wall, wherein a curvature of a curved surface of the partition wall at the tip end of the partition wall is larger than a curvature of an arc having a diameter equal to a width of the partition wall.

* * * * *